US010130181B1

(12) United States Patent
Chen

(10) Patent No.: US 10,130,181 B1
(45) Date of Patent: Nov. 20, 2018

(54) DIRECTOR'S CHAIR

(71) Applicant: Xiamen HCF Outdoor Products Co., Ltd., Xiamen, Fujian (CN)

(72) Inventor: Hui Chen, Xiamen (CN)

(73) Assignee: XIAMEN HCF OUTDOOR PRODUCTS CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/869,102

(22) Filed: Jan. 12, 2018

(30) Foreign Application Priority Data

May 19, 2017 (CN) ..... 2017 2 0560122 U

(51) Int. Cl.
*A47C 4/28* (2006.01)

(52) U.S. Cl.
CPC ..... *A47C 4/283* (2013.01)

(58) Field of Classification Search
CPC ..... A47C 4/283
USPC ..... 297/45
See application file for complete search history.

(56) References Cited

U.S. PATENT DOCUMENTS

| | | | | |
|---|---|---|---|---|
| 9,370,246 | B2 * | 6/2016 | Baoqing | A47C 7/543 |
| 9,795,217 | B2 * | 10/2017 | Grace | A47C 4/283 |
| 2003/0025362 | A1 * | 2/2003 | Liu | A47C 4/283 297/45 |
| 2010/0171342 | A1 * | 7/2010 | Chen | A47C 4/283 297/45 |
| 2011/0169304 | A1 * | 7/2011 | Chen | A47C 4/283 297/35 |
| 2018/0140098 | A1 * | 5/2018 | Lv | A47C 4/283 |

* cited by examiner

*Primary Examiner* — Milton Nelson, Jr.
(74) *Attorney, Agent, or Firm* — Leong C. Lei

(57) ABSTRACT

A director's chair includes two support frames and two cross rod assemblies connected to the front ends and rear ends of the two support frames. The director's chair is folded or unfolded by controlling support rods of the cross rod assemblies to be folded or unfolded. The height of the folded director's chair is only the height of leg rods of the support frames. An armrest rod, a seat rod and a backrest rod of the support frame can be folded at the side of the leg rods, so that the size of the director's chair is small enough to facilitate the storage and transportation.

3 Claims, 6 Drawing Sheets

DIRECTOR'S CHAIR

BACKGROUND OF THE INVENTION

1. Field of the Invention

The present invention relates to a chair structure, and more particularly to a director's chair.

2. Description of the Prior Art

There are many types of folding chairs on the market. Folding chairs can be classified as a steel and wood structure and a steel fabric structure according to the materials used. A steel fabric folding chair has a support frame made of steel alloy and a seat made of an Oxford fabric or other soft fabrics. The soft seat can be folded along with the fold of the support frame. The support frame may be fully folded or bilaterally folded. When the former is unfolded, the seat fabric is loose. The user may sit in a leisurely manner. It is suitable for travel and leisure occasions. The latter is to rely on two horizontal rods to tighten the seat fabric. After sitting, the concave is not obvious. The sitting posture is relatively upright. It is more comfortable than a steel and wood chair, so it can be used in the workplace, such as performance places, music audition rooms and the like. This chair is often used as a director's chair.

As shown in FIG. 1 to FIG. 3, a chair frame of a conventional director's chair comprises two support frames 1' which are bilaterally symmetric and two cross rod assemblies 2' connected to the front ends and the rear ends of the two support frames 1'. Each support frame 1' includes two leg rods 11', an armrest rod 12', a seat rod 13', and a backrest rod 14'. One end of each of two rod members of each cross rod assembly 2' is provided with a connector 3'. Another end of each of the two rod members of each cross rod assembly 2' is pivotally connected to a slider 4'. The slider 4' is sleeved on the leg rod 11' and can slide up and down along the leg rod 11'. Respective two ends of the armrest rod 12' and the seat rod 13' are pivotally connected to the connectors 3' on the cross rod assemblies 2'. The backrest rod 14' is pivotally connected to the rear end of the armrest rod 12'. This director's chair is small in size after folded. The armrest rods 12', the seat rods 13' and the backrest rods 14' of the director's chair are connected to the cross rod assemblies 2' only through the connectors 3'. When in use, the centers of the two seat rods 13' of the director's chair is under stress. Since the armrest rods 12', the seat rods 13' and the backrest rods 14' are connected to the cross rod assemblies 2' only through the connectors 3', after the center of the director's chair is under stress, the jointed ends would be tilted towards the middle, resulting in shaking of the director's chair. The strength and stability of this director's chair are poor. In addition, when the director's chair is folded, multiple steps are required. First, the cross rod assemblies 2' are folded so that the two support frames 1' are folded side by side. Secondly, the backrest rod 14' is folded to abut against the armrest rod 12'. Thirdly, the armrest rod 12' is folded downward with the connector 3' as the pivot and is brought close to the leg rods 11'. After these three steps, the director's chair is folded. Therefore, this director's chair is troublesome for folding and has poor support strength and stability.

Accordingly, the inventor of the present invention has devoted himself based on his many years of practical experiences to solve these problems.

SUMMARY OF THE INVENTION

The primary object of the present invention is to provide a director's chair that is stable and convenient for use and can be folded quickly.

In order to achieve the aforesaid object, the director's chair of the present invention comprises two support frames which are bilaterally symmetrical and two cross rod assemblies connected to front ends and rear ends of the two support frames. Each of the support frames includes two leg rods, an armrest rod, a seat rod, and a backrest rod. A top of each of the leg rods is provided with a fixing seat. Each of the leg rods is provided with a slider which is movable along the leg rod. The armrest rod includes two erect rods and a horizontal rod connected between top ends of the two erect rods. A bottom end of each of the erect rods is pivotally connected to one end of an oblique rod. Another end of the oblique rod is pivotally connected to the slider. The seat rod is located between the two erect rods. Two ends of the seat rod are connected to the two erect rods through two connecting rods, respectively. Another end of each of the connecting rods is pivotally connected to the fixing seat. The backrest rod is pivotally connected to a rear end of the horizontal rod of the armrest rod through a limit connector. Each of the cross rod assemblies includes two support rods with their middles hinged to each other. The two support rods of one of the two cross rod assemblies have respective upper ends pivotally connected to the fixing seats of the leg rods at the front ends of the two support frames and respective lower ends pivotally connected to the sliders of the leg rods at the front ends of the two support frames. The two support rods of the other of the two cross rod assemblies have respective upper ends pivotally connected to the fixing seats of the leg rods at the rear ends of the two support frames and respective lower ends pivotally connected to the sliders of the leg rods at the rear ends of the two support frames. The seat rods of the two support frames are provided with a seat fabric. The backrest rods of the two support frames are provided with a backrest fabric.

Preferably, a bottom rod is connected between bottom ends of the two leg rods of each of the support frames. The bottom rod and the two leg rods form a U-shaped frame.

Preferably, the leg rods of the two support frames are arranged in the form of a Chinese character "八".

Preferably, the limit connector includes two plates and a stop plate connected to rear ends of the two plates. The backrest rod is fixed between the two plates of the limit connector. One end of each of the plates is pivotally connected to the rear end of the horizontal rod of the armrest rod.

The seat rod and the backrest rod of the director's chair of the present invention is directly disposed on the armrest rod. The leg rods serve as the main support part of the support frame. By providing the fixing seat and the slider on each leg rod, the armrest rod is linked by the leg rods through the connecting rod and the oblique rod to be folded or unfolded. The two support frames are connected through the cross rod assemblies, having the advantages of simple structure, stable support, better safety and high reliability, convenient use, and so on. The director's chair is folded or unfolded by controlling the support rods of the cross rod assemblies to be folded or unfolded. The height of the folded director's chair is only the height of the leg rods. The armrest rod, the seat rod and the backrest rod can be folded at the side of the leg rods, so that the size of the director's chair is small enough to facilitate the storage and transportation.

DETAILED DESCRIPTION OF THE PREFERRED EMBODIMENTS

Embodiments of the present invention will now be described, by way of example only, with reference to the accompanying drawings.

Figure 4:
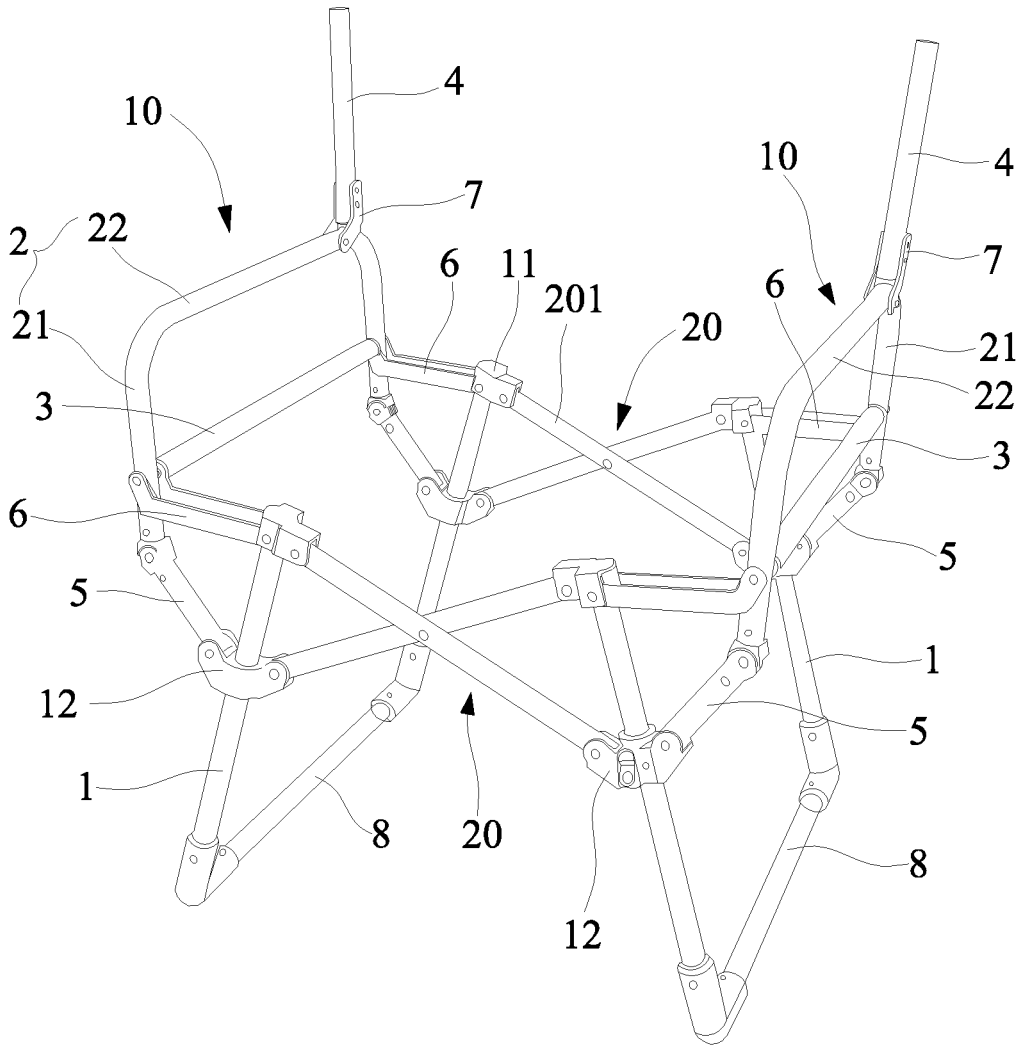
FIG. 4 is a perspective view of the director's chair of the present invention in an unfolded state.
Figure 5:
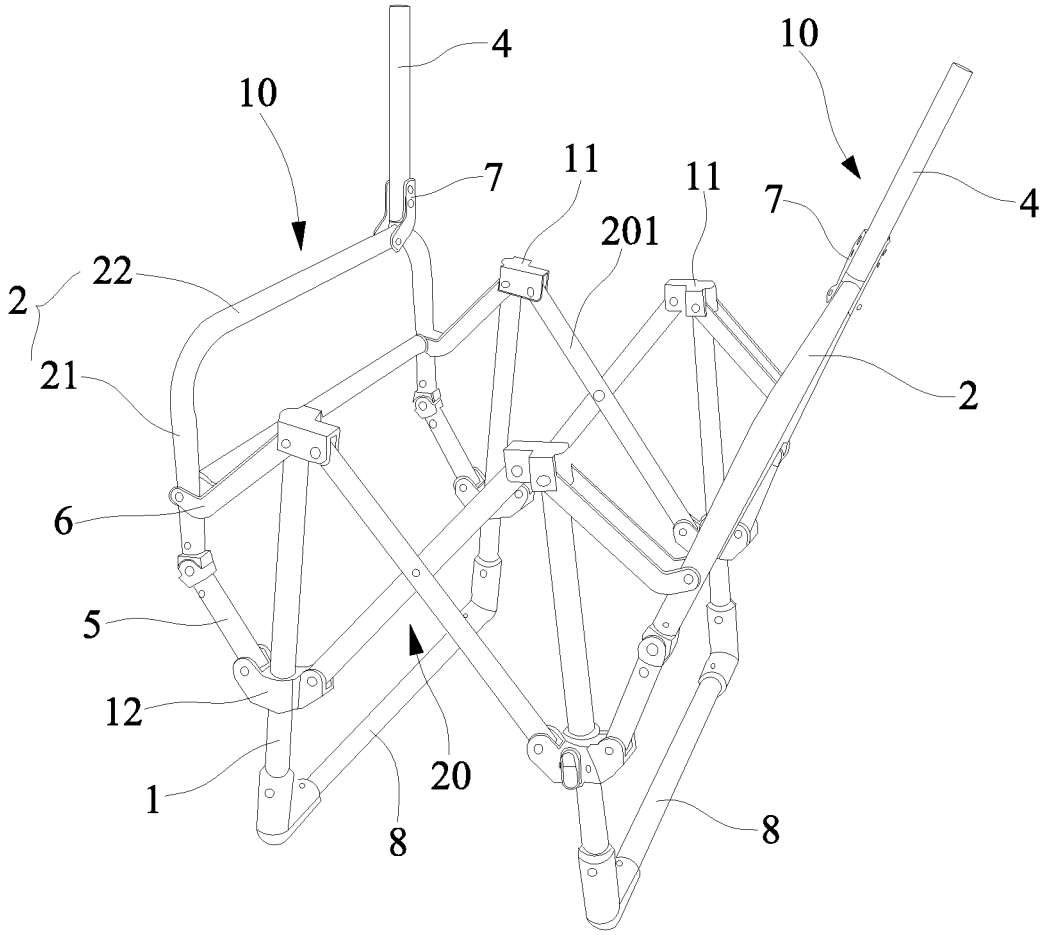
FIG. 5 is a schematic view showing the operation of folding the director's chair of the present invention.
Figure 6:
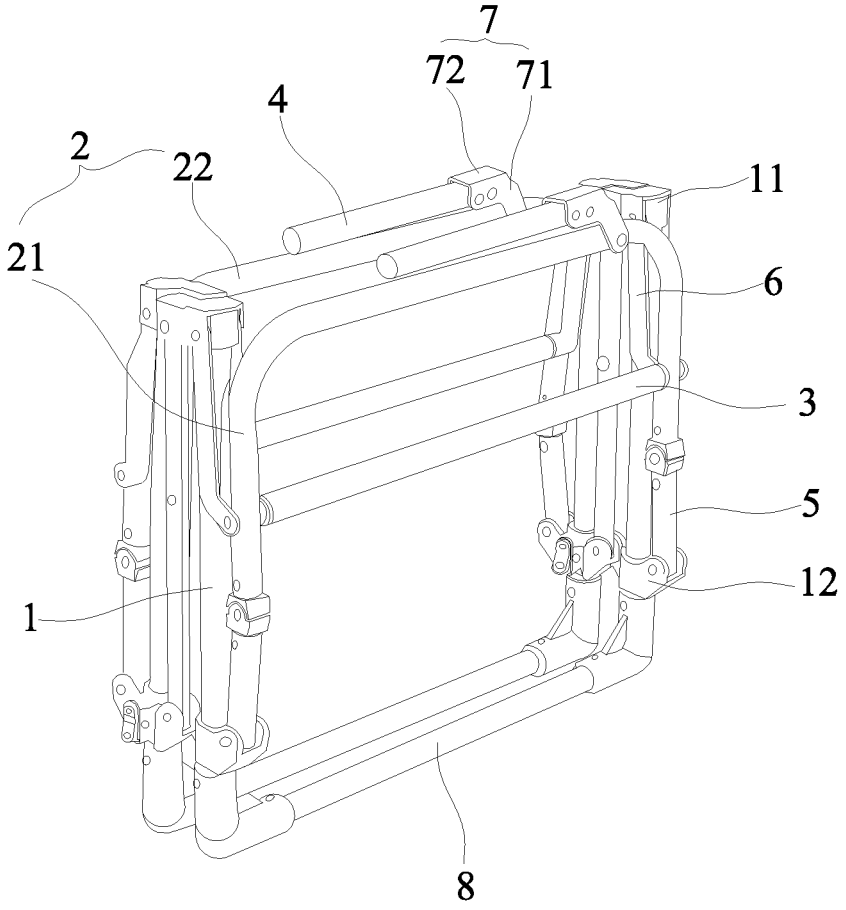
FIG. 6 is a perspective view of the director's chair of the present invention in a folded state.

As shown in FIG. 4 to FIG. 6, the present invention discloses a director's chair. The director's chair comprises two support frames 10 which are bilaterally symmetrical and two cross rod assemblies 20 connected to the front ends and the rear ends of the two support frames 10.

Each support frame 10 includes two leg rods 1, an armrest rod 2, a seat rod 3, and a backrest rod 4. The top of each leg rod 1 is provided with a fixing seat 11. Each leg rod 1 is provided with a slider 12 which is movable along the leg rod 1. The armrest rod 2 includes two erect rods 21 and a horizontal rod 22 connected between the top ends of the two erect rods 21. The bottom end of each erect rod 21 is pivotally connected to one end of an oblique rod 5. Another end of the oblique rod 5 is pivotally connected to the slider 12. The seat rod 3 is located between the two erect rods 21, and two ends of the seat rod 3 are connected to the two erect rods 21 through two connecting rods 6, respectively. Another end of each connecting rod 6 is pivotally connected to the fixing seat 11. The backrest rod 4 is pivotally connected to the rear end of the horizontal rod 22 of the armrest rod 2 through a limit connector 7. A bottom rod 8 is connected between the bottom ends of the two leg rods 1 of each support frame 10. The bottom rod 8 and the two leg rods 1 form a U-shaped frame. The limit connector 7 includes two plates 71 and a stop plate 72 (as shown in FIG. 6) connected to the rear ends of the plates 71. The backrest rod 4 is fixed between the two plates 71 of the limit connector 7. One end of each plate 71 is pivotally connected to the rear end of the horizontal rod 22 of the armrest rod 2.

Each cross rod assembly 20 includes two support rods 201 with their middles hinged to each other. The upper ends of the two support rods 201 of one of the two cross rod assemblies 20 are respectively pivotally connected to the fixing seats 11 of the leg rods 1 at the front ends of the two support frames 10, and the lower ends of the two support rods 201 are respectively pivotally connected to the sliders 12 of the leg rods 1 at the front ends of the two support frames 10. The upper ends of the two support rods 201 of the other of the two cross rod assemblies 20 are respectively pivotally connected to the fixing seats 11 of the leg rods 1 at the rear ends of the two support frames 10, and the lower ends of the two support rods 201 are respectively pivotally connected to the sliders 12 of the leg rods 1 at the rear ends of the two support frames 10.

The seat rods 3 of the two support frames 10 are provided with a seat fabric. The backrest rods 4 of the two support frames 10 are provided with a backrest fabric (not shown in the figures).

In order to make the director's chair more stable, the leg rods 10 of the two support frames 10 are arranged in the form of a Chinese character "八".

Figure 1:
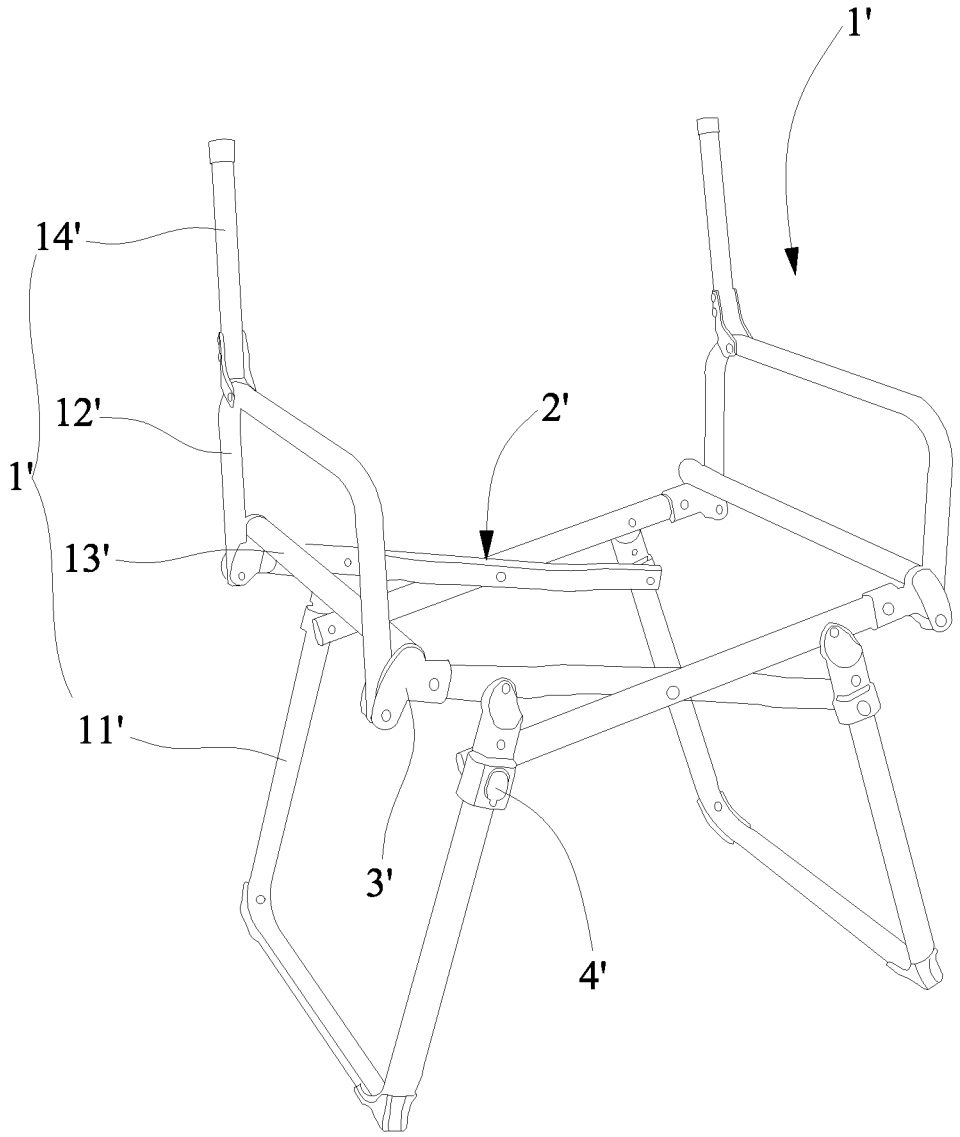
FIG. 1 is a perspective view of a conventional director's chair in an unfolded state.
Figure 2:
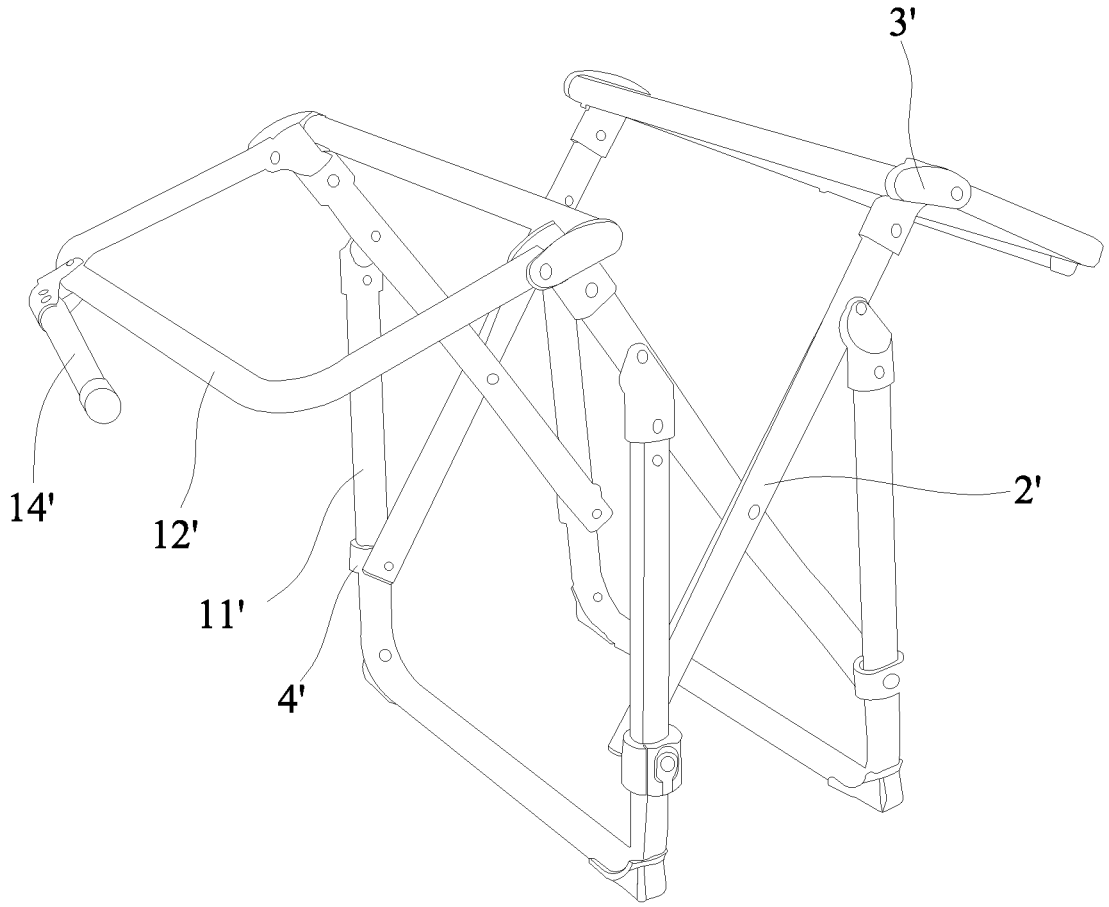
FIG. 2 is a schematic view showing the operation of folding the conventional director's chair.
Figure 3:
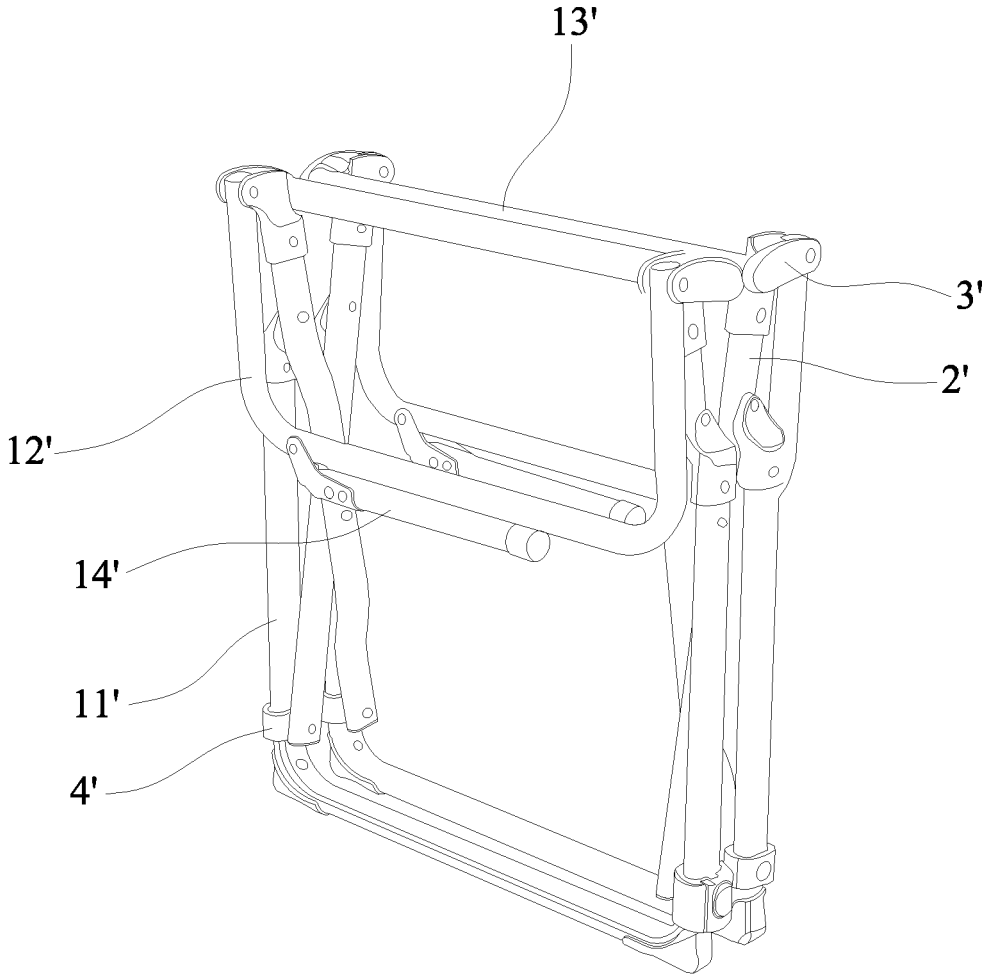
FIG. 3 is a perspective view of the conventional director's chair in a folded state.

When the director's chair of the present invention is unfolded, as shown in FIG. 1, the leg rods 10 of the two support frames 10 are extended in the form of a Chinese character "八". The slider 12 is located at the top half of the corresponding leg rod 1 under the action of the cross rod assembly 20. The armrest rod 2 is located above the outside of the leg rods 1 under the action of the oblique rod 5 and the connecting rod 6. Then, the backrest rod 4 is manually operated to make the backrest rod 4 perpendicular to the horizontal rod 22 of the armrest rod 2. As shown in FIG. 2 and FIG. 3, when the director's chair is folded, the lower ends of the two support rods 201 of the cross rod assembly 20 are controlled to move toward the bottoms of the leg rods 1. The sliders 12 on the leg rods 1 are driven to move downward along with the movement of the support rods 201. The sliders 12 drive the oblique rods 5 to move the armrest rod 2 downward toward the leg rods 1. While the armrest rods 2 are moved downward to approach the leg rods 1, the connecting rods 6 also follow the downward movement. When the support rods 201 of the two cross rod assemblies 20 are folded close to each other, the front two leg rods 1 and the rear two leg rods 1 of the two support frames 10 are also folded close to each other. The sliders 12 along with the movement of the support rods 201 enable the oblique rods 5, the armrest rods 2 and the connecting rods 6 to be folded at the two sides of the leg rods 1 and to abut against the leg rods 1. Then, the backrest rods 4 are manually turned to the horizontal rods 22 of the armrest rods 2, so that the director's chair is folded to the minimum size.

The seat rod 3 and the backrest rod 4 of the director's chair of the present invention is directly disposed on the armrest rod 2. The leg rods 1 serve as the main support part of the support frame 10. By providing the fixing seat 11 and the slider 12 on each leg rod 1, the armrest rod 2 is linked by the leg rods 1 through the connecting rod 6 and the oblique rod 5 to be folded or unfolded. The two support frames 10 are connected through the cross rod assemblies 20, having the advantages of simple structure, stable support, better safety and high reliability, convenient use, and so on. The director's chair is folded or unfolded by controlling the support rods 201 of the cross rod assemblies 20 to be folded or unfolded. The height of the folded director's chair is only the height of the leg rods 1. The armrest rod 2, the seat rod 3 and the backrest rod 4 can be folded at the side of the leg rods 1, so that the size of the director's chair is small enough to facilitate the storage and transportation.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A director's chair, comprising two support frames which are bilaterally symmetrical and two cross rod assemblies connected to front ends and rear ends of the two support frames; each of the support frames including two leg rods, an armrest rod, a seat rod and a backrest rod, a top of each of the leg rods being provided with a fixing seat, each of the leg rods being provided with a slider which is movable along the leg rod, the armrest rod including two erect rods and a horizontal rod connected between top ends of the two erect rods, a bottom end of each of the erect rods being pivotally connected to one end of an oblique rod, another end of the oblique rod being pivotally connected to the slider, the seat rod being located between the two erect rods, two ends of the seat rod being connected to the two erect rods through two connecting rods respectively, another end of each of the connecting rods being pivotally connected to the fixing seat, the backrest rod being pivotally connected to a rear end of the horizontal rod of the armrest rod through a limit connector; each of the cross rod assemblies including two support rods with their middles hinged to each other, the two support rods of one of the two cross rod assemblies having respective upper ends pivotally connected to the fixing seats of the leg rods at the front ends of the two support frames and respective lower ends pivotally connected to the sliders of the leg rods at the front ends of the two support frames, the two support rods of the other of the two cross rod assemblies having respective upper ends pivotally connected to the fixing seats of the leg rods at the rear ends of the two support frames and respective lower ends pivotally connected to the sliders of the leg rods at the rear ends of the two support frames; the seat rods of the two support frames being provided with a seat fabric, the backrest rods of the two support frames being provided with a backrest fabric.

2. The director's chair as claimed in claim 1, wherein a bottom rod is connected between bottom ends of the two leg rods of each of the support frames, and the bottom rod and the two leg rods form a U-shaped frame.

3. The director's chair as claimed in claim 1, wherein the limit connector includes two plates and a stop plate connected to rear ends of the two plates, the backrest rod is fixed between the two plates of the limit connector, and one end of each of the plates is pivotally connected to the rear end of the horizontal rod of the armrest rod.

* * * * *